US008578564B2

(12) United States Patent
Policicchio et al.

(10) Patent No.: US 8,578,564 B2
(45) Date of Patent: Nov. 12, 2013

(54) HANDLE FOR REMOVABLE CLEANING IMPLEMENT

(75) Inventors: Nicola John Policicchio, Mason, OH (US); David Calvert Rucker, Cincinnati, OH (US); David William Schuller, Lebanon, OH (US); Richard Christopher Hagee, Columbus, OH (US); Diana Woehnl Juratovac, Columbus, OH (US); Richard Lee Lane, Columbus, OH (US); Ryan Robert Berger, Columbus, OH (US); Ranier Bernhard Teufel, Worthington, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 555 days.

(21) Appl. No.: 12/613,015

(22) Filed: Nov. 5, 2009

(65) Prior Publication Data

US 2011/0099764 A1 May 5, 2011

(51) Int. Cl.
*B25G 3/32* (2006.01)

(52) U.S. Cl.
USPC ..... 16/422; 15/145; 15/229.3; 15/229.4

(58) Field of Classification Search
USPC ..... 16/110.1, 421, 422; D32/52; 15/147.1, 15/147.2, 145, 209.1, 210.1, 229.1, 229.2, 15/229.3, 229.4, 229.7, 229.8
See application file for complete search history.

(56) References Cited

U.S. PATENT DOCUMENTS

| | | | | |
|---|---|---|---|---|
| 823,725 | A | 6/1906 | Hayden | |
| 3,413,673 | A | 12/1968 | Gewirz | |
| 4,010,511 | A | 3/1977 | Komatsu | |
| 4,627,758 | A | 12/1986 | Winthrop | |
| 4,829,622 | A | 5/1989 | O'Sullivan | |
| 4,905,337 | A | 3/1990 | McKay | |
| 5,027,465 | A | 7/1991 | McKay | |
| 5,953,784 | A | 9/1999 | Suzuki et al. | |
| 6,047,435 | A | 4/2000 | Suzuki et al. | |
| 6,127,014 | A | 10/2000 | McKay, Jr. | |
| 6,427,278 | B1 | 8/2002 | McKay, Jr. | |
| 6,449,794 | B1 | 9/2002 | Jaffri | |
| 6,688,464 | B2 | 2/2004 | Jessen et al. | |
| 6,763,977 | B2 | 7/2004 | McKay | |
| 6,813,801 | B2 * | 11/2004 | Tanaka et al. | 15/229.3 |
| 6,842,934 | B1 | 1/2005 | McKay, Jr. et al. | |
| 6,859,976 | B2 | 3/2005 | Plankenhorn | |

(Continued)

FOREIGN PATENT DOCUMENTS

| | | |
|---|---|---|
| EP | 1 891 879 A2 | 2/2008 |
| EP | 1 967 118 A2 | 9/2008 |

(Continued)

OTHER PUBLICATIONS

International Search Report dtd Feb. 1, 2011, 11 Pages.

*Primary Examiner* — William Miller
(74) *Attorney, Agent, or Firm* — Larry L. Huston; Steven W. Miller

(57) ABSTRACT

A handle for receiving a cleaning article, such as a dusting device. The handle has one or more tines which are disposed outboard of a reference plane. This geometry provides a friction fit for receiving a removable cleaning device on the tines, without substantial interference. The friction fit retains the cleaning article on the handle during use while reducing tearing which occurs during installation.

14 Claims, 2 Drawing Sheets

(56) References Cited

U.S. PATENT DOCUMENTS

| | | | | |
|---|---|---|---|---|
| 6,865,765 | B2 | 3/2005 | Aalbers | |
| 6,954,963 | B2 | 10/2005 | McKay | |
| 6,968,591 | B2 * | 11/2005 | Tanaka | 15/229.1 |
| 6,978,509 | B2 | 12/2005 | Lin | |
| 7,090,908 | B1 | 8/2006 | McKay | |
| 7,186,207 | B2 | 3/2007 | McKay, Jr. et al. | |
| 7,188,384 | B2 | 3/2007 | McKay | |
| 7,219,386 | B2 | 5/2007 | Tsuchiya et al. | |
| 7,251,851 | B2 | 8/2007 | Lin et al. | |
| 7,293,317 | B2 | 11/2007 | Tsuchiya et al. | |
| 7,383,602 | B2 | 6/2008 | Tanaka et al. | |
| D579,615 | S | 10/2008 | Ames et al. | |
| 7,487,566 | B2 | 2/2009 | McKay, Jr. et al. | |
| 7,716,777 | B2 * | 5/2010 | Lee | 15/229.3 |
| 7,745,354 | B2 * | 6/2010 | Tsuchiya et al. | 442/123 |
| 7,788,759 | B2 * | 9/2010 | Yang et al. | 15/229.3 |
| 7,803,726 | B2 * | 9/2010 | Policicchio et al. | 442/123 |
| 7,891,898 | B2 * | 2/2011 | Hoadley et al. | 401/123 |
| 7,930,794 | B2 * | 4/2011 | Tsutanaga et al. | 15/229.3 |
| 7,937,797 | B2 * | 5/2011 | Tsuchiya et al. | 15/229.3 |
| 8,151,403 | B2 * | 4/2012 | Wada et al. | 15/229.4 |
| 2004/0034956 | A1 | 2/2004 | Tanaka et al. | |
| 2005/0215459 | A1 | 9/2005 | Policicchio et al. | |
| 2006/0009337 | A1 | 1/2006 | Smith | |
| 2006/0101602 | A1 | 5/2006 | Lin et al. | |
| 2006/0171764 | A1 | 8/2006 | Hoadley | |
| 2006/0260082 | A1 | 11/2006 | Bonilla | |
| 2006/0265823 | A1 | 11/2006 | Knopow et al. | |
| 2008/0040873 | A1 | 2/2008 | Schmidt | |
| 2008/0145586 | A1 | 6/2008 | Kawada et al. | |
| 2008/0193694 | A1 | 8/2008 | McKay et al. | |

FOREIGN PATENT DOCUMENTS

| | | |
|---|---|---|
| JP | A-H08-336493 | 12/1996 |
| JP | A-2007-044088 | 2/2007 |
| JP | A-2007-185225 | 7/2007 |

* cited by examiner

HANDLE FOR REMOVABLE CLEANING IMPLEMENT

BACKGROUND OF THE INVENTION

Various cleaning articles have been created for dusting and light cleaning. For example, cloth rags and paper towels used dry or wetted with polishing and cleaning compositions have been used on relatively flat surfaces. But, rags and paper towels are problematic for reasons such as hygiene (the user's hand may touch chemicals, dirt or the surface during cleaning), reach (it may be difficult to insert the user's hand with the rag or paper towel into hard-to-reach places) and inconvenience (cleaning between closely-spaced articles typically requires moving the articles).

To overcome the problems associated with using rags and paper towels, various dust gathering devices having feathers, lamb's wool, and synthetic fibers brushes have been utilized for more than a century as illustrated by U.S. Pat. No. 823,725 issued in 1906 to Hayden. Such dust gathering devices can be expensive to manufacture, and are therefore designed to be cleaned and reused. Disposable cleaning article have been developed which have limited re-usability. These disposable cleaning articles may include brush portions made of synthetic fiber bundles attached to a non-woven sheet. The dust gathering cleaning article may be elongate along a longitudinal axis, flat, and/or may be "fluffable" to increase the surface area of the fibers. Such devices may be made, for example, according to U.S. Pat. Nos. 6,047,435; 6,813,801 B2, and/or EP 1,299,026 B1.

These references disclose disposable cleaning articles attachable to and removable from a reusable handle, such as generally illustrated in WO 02/34101 A1 filed Oct. 25, 2001. The handle may have a grip which is held by the user during cleaning and one or more means for removably attaching the handle to the disposable cleaning article. Common means for removably attaching the handle to the duster include one or more elongate tines. The one or more tines may be inserted into one or more respective complementary sleeves disposed on the cleaning article. One common geometry comprises two longitudinally parallel elongate times on the handle which are inserted into complementary longitudinally parallel elongate sleeves disposed on the attachment side of the cleaning article.

Various attempts have been made to improve upon the handle. For example, U.S. Pat. No. 6,978,509 and U.S. Pat. No. 7,293,317 teach a handle having a hand grip pivotally secured to the fork and a support member pivotally connected to the front of the handle, respectively. U.S. Pat. No. 4,788,435 teaches a brush body rotatable mounted on a holder. U.S. Pat. No. 7,219,386 teaches a telescopic handle. However, these developments do not assist with retention of the cleaning device on the handle.

U.S. Pat. No. 3,413,673 and D572,813S teach handles having corrugations to frictionally engage the duster. The corrugations generally extend from the top, or wider face, of the tine. This geometry has the disadvantage that the corrugations may tear the duster when it is being inserted on the tines. U.S. D579,615 S, sold by the instant assignee under the name Swiffer Dusters®, and the aforementioned U.S. Pat. No. 7,383,602 teach tines having thin, deformable projections extending from the sides, or narrow faces, of the tines. These references further teach a clip, disposed near the proximal ends 20 of the tines. However, the projections and clip can likewise cause tearing of the cleaning article upon insertion.

One attempt in the other direction is shown in U.S. Pat. No. 6,047,435 which teaches a monotocally increasing head portion. A similar attempt is found in the commercially available Azuma handle. This handle has minor undulations in the vertical direction, which undulations are small compared to the thickness of the tines and do not provide significant friction against the cleaning article. These arrangements do not adequately retain the cleaning device during use. An attempt to overcome this problem is found in U.S. Pat. No. 5,953,784 which teaches a handle having a dedicated attachment portion. But this approach increases both and complexity of assembly.

Another approach is shown in U.S. Pat. No. 7,251,851 which teaches a single spiral member. The front end of the spiral member is biforked. However, this arrangement is even more complex than any previously discussed, as it requires an inflected member. Further, this type of member also contributes to tearing of the cleaning member. Likewise, the planar handle of U.S. Pat. No. 4,829,622 contributes to tearing of the cleaning device.

While attempts to improve the cleaning characteristics of dust gathering devices have been made, the search still continues to reduce the problems and inefficiencies of dusters, particularly as related to a plural sided duster for cleaning a target surface.

SUMMARY OF THE INVENTION

The invention comprises an elongate handle for removably receiving a cleaning implement. The handle has a longitudinal axis and comprises a grip and at least one tine. The tine is attached at a proximal end to the grip. Each tine extends from the proximal end to a respective distal end. Each tine defines a reference plane which is parallel to the longitudinal axis. At least a portion of the tine is non-coplanar with the reference plane.

DETAILED DESCRIPTION OF THE INVENTION

The cleaning article (not shown) may be generally elongate, having a longitudinal axis, although other shapes are feasible as well. The cleaning article may be removably attachable to a handle 10, as shown.

Figure 1:
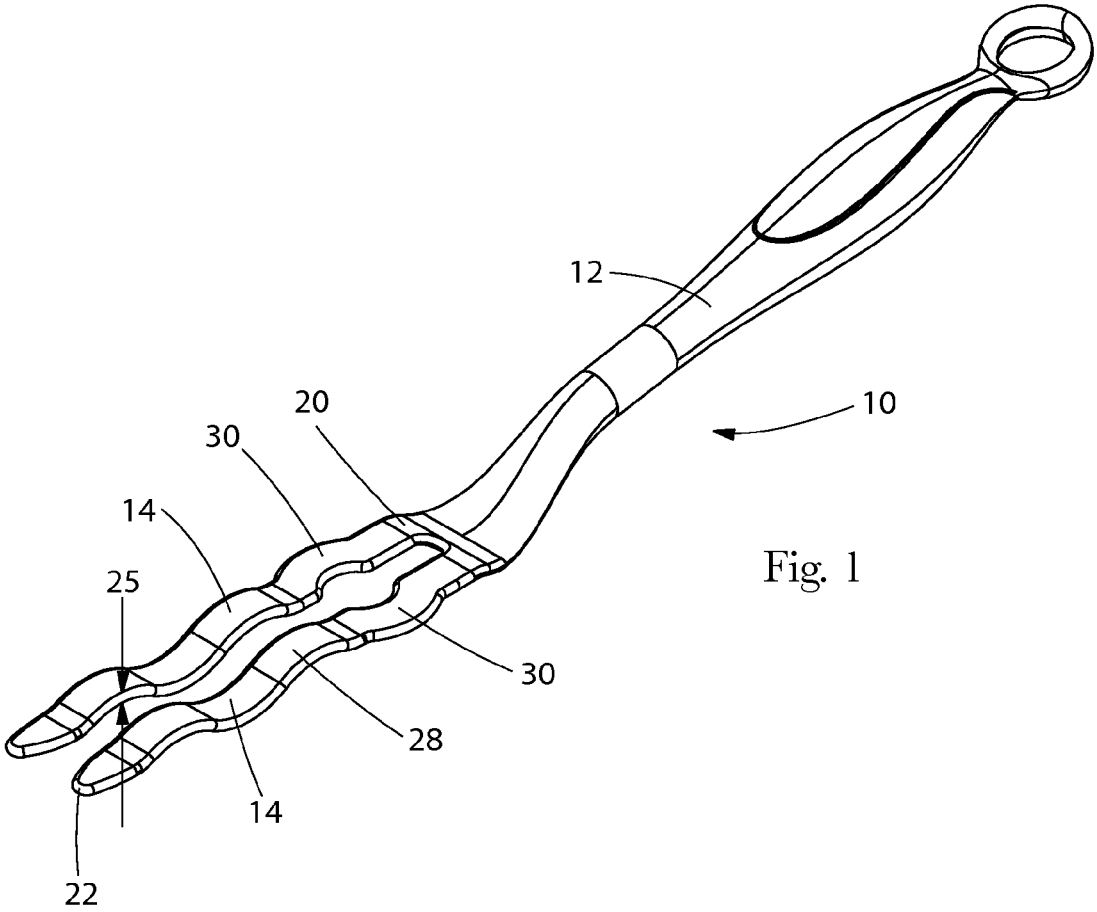
FIG. 1 is a perspective view of a handle and duster according to the present invention, the tines of the handle being shown of equal and determinate length, the reference plane being omitted for clarity.
Figure 3:
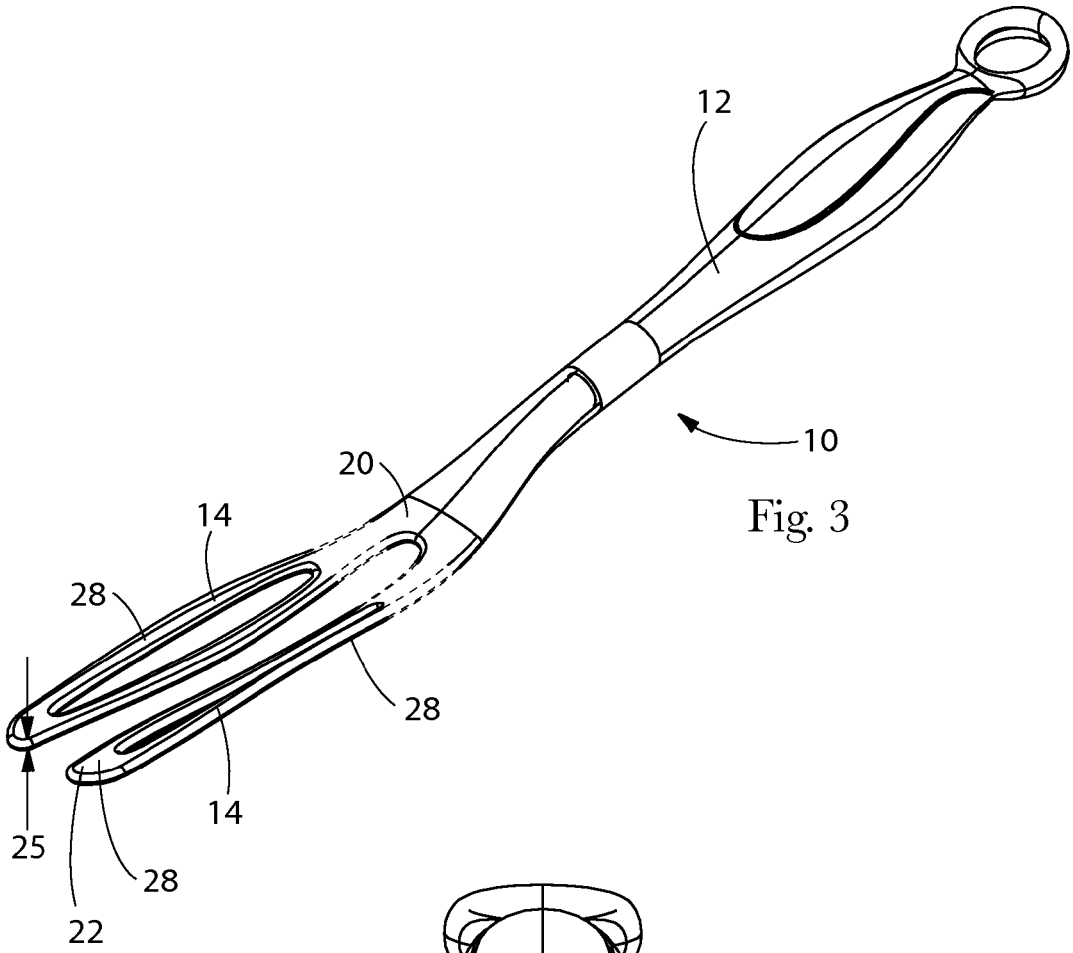
FIG. 3 is a perspective view of a handle and duster according to the present invention, the tines of the handle being shown of indeterminate and not necessarily equal length, the reference plane being omitted for clarity.

Referring to FIGS. 1 and 3, the handle 10 may be elongate, and comprise a grip 12 and one or more tines 14 which function as one means of handle attachment to a complementary cleaning article attachment system. The cleaning article attachment system and complementary handle attachment may comprise adhesive joining, cohesive joining, mechanical engagement, etc.

The handle attachment may be removably attached to and attachably removed from the cleaning article attachment system. The handle attachment and cleaning article attachment system are considered complementary if they allow for such removable attachment without destruction or undue distortion of either such component, it being recognized the handle 10 is intended for multiple uses and the cleaning article may be intended for a single cleaning job.

With continuing reference to FIG. 1 and examining the handle 10 in more detail, the handle 10 may comprise one or more handle attachments, such as tines 14, for attachment to the cleaning article attachment mechanism and a grip 12, which is held by the user. The handle 10 may facilitate reach and maneuverability, provide pressure to the target surface to improve cleaning, and separation between the target surface and the user's hands. A handle 10 removably attachable to the cleaning article and falling within the scope of the appended claims is contemplated.

The handle 10 may be removably attached to the cleaning article directly or may be indirectly connected through another member using any operative connection, including mechanical and chemical means. By way of non-limiting example, hook and loop fasteners, adhesive, cohesive attachment, or mechanical engagement may be used to removably attach the handle 10 and cleaning article. If mechanical engagement is selected, the cleaning article may have a sleeve complementary to and for receiving one or more tines 14 of the cleaning article. Each tine 14 of the handle 10 may be generally flat, of constant or variable cross section, may be curvilinear in the plane of the grip 12 or the plane perpendicular thereto, and may be of the same or different size, length and geometry.

The tines 14 may be cantilevered from the grip 12. The grip 12 and tines 14 may be unitary/integral or may comprise two or more parts joinable together. The grip 12 may be generally parallel or skewed relative to one another and may be generally oriented parallel the longitudinal axis. While two tines 14 are shown, the handle 10 may comprise a single, concave tine 14, or three or more tines 14 collectively forming a concave geometry or otherwise deviating from a reference plane. Any concave, and prophetically convex, configuration which allows the tine 14 to engage and hold the cleaning article, as described, is suitable. The grip 12 may also be generally longitudinally oriented, parallel to and in line with or offset from the one or more tines 14. The handle 10 may be telescoping, or otherwise extendable/retractable and/or articulating.

The z-direction of the cleaning article is the direction perpendicular to the non-woven layer closest to the handle 10; the x-y plane of the cleaning article is defined as the plane defined by the non-woven layer closest to the handle 10. The length of the cleaning article, sleeve, etc. is taken in the longitudinal direction. The width of the cleaning article corresponds to the direction perpendicular to the length and disposed within the plane of the attachment layers. The thickness 25 is defined as the average dimension in the z-direction. The longitudinal direction is the major direction of the cleaning article, handle 10 or a component thereof. As used herein, longitudinally offset refers to a disposition of two or more components, or points on one or more components, which do not lie on a common position along the longitudinal axis.

The cleaning article may be used for one job and discarded, or may be restored and re-used for more jobs, then discarded. The cleaning article may comprise one or more construction portions. The construction portions may be laminated together. Each construction portion may have a first outwardly facing preferential cleaning side and a second inwardly facing attachment side opposed thereto. An individual construction portion may be usable as a sided cleaning implement, as known in the art. The first layer may comprise a nonwoven sheet. Suitable nonwovens may be made according to commonly assigned U.S. Pat. Nos. 6,797,357; 6,936,330, D489,537 and/or D499,887.

Two or more plies may be joined together to create one or more third layers by thermal bonding, autogenous bonding, adhesive or other means known in the art. The bonding joining the two plies may be provided in a pattern which provides a sleeve complementary to and able to receive the tines 14 of the handle 10. The bonding may be provided in a pattern which is generally longitudinally oriented, so that the tines 14 may be inserted into the pocket or sleeve created between adjacent bonds.

The sleeve may have an exposed portion with a longitudinal dimension of at least 5 mm. This length is sufficient for most users to manipulate and attach the handle 10 thereto by inserting the tines 14 into the sleeve.

If desired, one layer may comprise a sheet which has been shrunk in the cross-direction. This process can provide rugosities or wrinkles in that layer. The rugosities/wrinkles space apart the layers, allowing for easier insertion of the tine 14 into the sleeve.

If desired, the cleaning article may optionally be used with a cleaning solution or other solution usable for other purposes such as treating the surface for appearance or disinfectant, etc. The cleaning solution may be pre-applied to the cleaning article, creating a pre-moistened cleaning article or may be contained within a separate reservoir for dosing onto the cleaning article and/or target surface.

With continuing reference to FIG. 1, the handle 10 is elongate, having a major direction parallel a longitudinal axis. The handle 10 comprises a grip 12 and one or more tines 14 which are attached or attachable to a cleaning article. While the invention is shown, for illustrative purposes, with two tines 14, one of skill will recognize the invention is not so limited, and only limited by the number of tines 14 set forth in the claims. Thus, while a single tine 14 is feasible, it has the drawback of a single failure allowing the system to become dysfunctional. Plural tines 14 overcome this disadvantage.

The grip 12 and tines 14 may or may not be collinear, and either may or may not be generally rectilinear. However, both are generally parallel the longitudinal direction. The tines 14 define a reference plane. The reference plane P-P is the plane through the major portion of the tines 14 and parallel the longitudinal direction. Colloquially, the reference plane P-P may be determined by placing the tines 14 on a flat, horizontal surface, and determining, in profile, the plane intercepted by the major portion of the tines 14. If the tines 14 are a minor image of each other, the reference plane P-P intercepts each tine 14 at equal angles.

Figure 2:
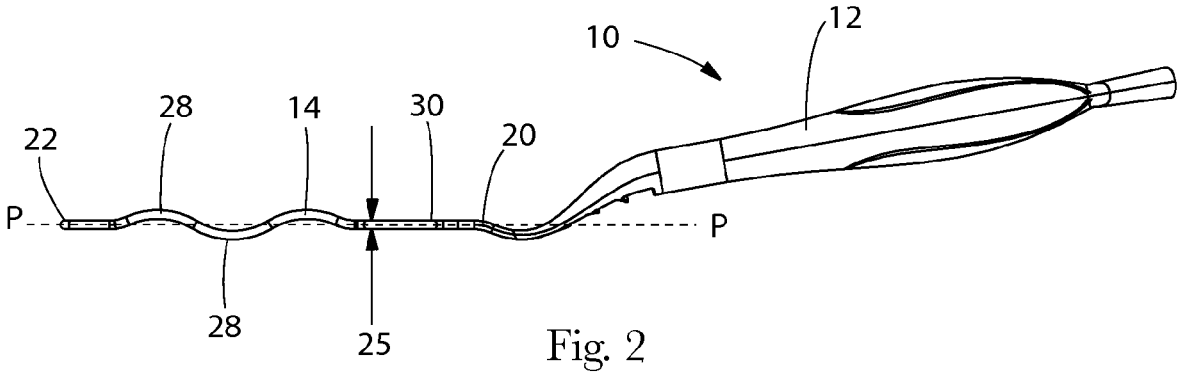
FIG. 2 is a side view of the handle in FIG. 1.

Referring to FIG. 2, in profile it can be seen the tines 14 alternatingly lie coplanar with and non-coplanar with the reference plane. That is to say, that the reference plane P-P intercepts the central portion of the tines 14. In the particular example shown in FIG. 2 the coplanar portions of the tines 14 alternatingly lie on opposed sides of the reference plane, i.e. above and below the reference plane. However, in alternative embodiments, the non-coplanar portions of the tines 14 could lie entirely above, or entirely below, the reference plane, but in any case are disposed on a common side of the reference plane.

The embodiment shown in FIG. 2 provides the advantage over the art that the portion of tines 14 below the reference plane P-P, or on the reference plane P-P if all non-coplanar portions are thereabove, reduce the contact area of the tines 14 against a target surface to be cleaned, compared to the generally planar tines 14 of the prior art. Such reduction in contact area increases the pressure applied to the target surface for constant force applied by the user's hand.

The embodiment of FIG. 2 further provides the coplanar portions of the tines are mutually coplanar, i.e. coplanar at the same positions on the longitudinal axis. This arrangement provides the advantage of constant cleaning across the width of the handle. However, in an alternative embodiment the undulations between the coplanar and non-coplanar portions may be skewed. This arrangement provides the advantage that more intricate surfaces and objects may be cleaned.

In an alternative embodiment, the portion of the tines 14 coplanar with the reference plane P-P need not have a longitudinal extent parallel thereto. Instead the coplanar portion of the tines 14 may simply cross the reference plane. In a degenerate case, the tines 14 may resemble a sine wave, with the coplanar portion as the inflection point disposed coincident the reference plane.

In any of the foregoing embodiments and variations, the tines 14 have a thickness 25 taken perpendicular to the reference plane. The tines 14 also have a width, taken parallel to the reference plane. The deviation between the tine 14 and the reference plane P-P is greater than the thickness 25 of the tine 14 for that portion of the time to be considered non-coplanar therewith.

FIG. 1 further shows optional protrusions 30 extending symmetrically and laterally in the outboard directions. The protrusions 30 may be omitted to reduce tearing of the cleaning article as it is installed on the tines 14.

Figure 4:
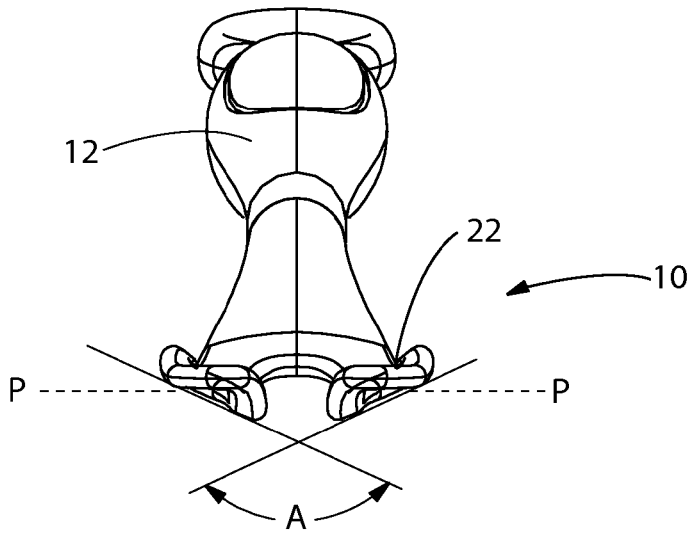
FIG. 4 is an end view of the handle in FIG. 3.

Referring to FIGS. 3-4, a substantial portion of the tines 14 may be parallel the longitudinal axis. However, such portion of the tines 14 may be non-coplanar with the reference plane P-P substantially throughout their length. As illustrated by FIG. 4, the tines 14 again resemble a blade having a thickness 25. The tines 14 are displaced from the reference plane P-P an amount greater than the thickness 25 of the blade.

Particularly, each tine 14 has an inboard edge proximate the longitudinal axis and a respective outboard edge transversely spaced away from the longitudinal axis. The outboard edges of the tines are disposed further from the reference plane P-P than the inboard edges of the tines. This geometry provides a generally concave arrangement, wherein the cleaning article is bent to conform to the concavity. The portion of the cleaning article which contacts the target surface is convex. The convex arrangement unexpectedly allows more cleaning fibers to reach into smaller spaces of articles being cleaned. Of course, one of skill will recognize that the opposite arrangement could be used, where in the inboard edges of the tines are further from the reference plane P-P and the outboard edges. Of course a hybrid arrangement combining one of each type of tine 15 could be used as well.

In any case, the distal ends 22 of the tines 14 may be generally parallel to the reference plane. This arrangement provides the benefit that the tines 14 are more readily insertable into the sleeves of the cleaning article. The portion of the tines 14 which extends perpendicularly away from the reference plane P-P provide the fit and friction to prevent unintended disengagement of the cleaning article during use.

Likewise, each tine 14 may be considered to have a shape generally like that of a flat blade. The width of the tine 14 may be generally greater in the center portion and lesser at the respective proximal end 20 and distal end 22 of that tine. Thus, the width of the tine 14 non-monotonically changes throughout its longitudinal extent. The tine 14 may further be provided with a slot therethrough. The slot provides the benefit of reducing stiffness of the tine 14, making it easier to conform to a target surface and to insert and remove the cleaning article.

The tines 14 may be thought of as having respective concave faces 28, facing towards each other and convex faces 28, facing outwardly from each other. Either of these faces 28 may be generally flat, as shown with the convex faces 28 or non-flat, as shown with the concave faces 28. The concave faces 28 may define an included angle A therebetween of about 90 to 140 degrees, and more particular about 110 to 130 degrees.

While FIGS. 1-4 show embodiments having two tines 14 which may be of equal length and are mirror images of each other, the invention is not so limited. The invention may be used with a handle 10 comprising a single tine 14 which is concave or otherwise has portions significantly disposed out of the reference plane. Likewise, the invention may be utilized with a handle 10 having three or more tines 14. Further, the tines 14 may be of equal or unequal length and may combine embodiments shown in FIGS. 1-2 and FIGS. 3-4. If an asymmetric arrangement of tines 14 is used, each tine 14 may be considered to define a respective reference plane. Furthermore, if a tine 14 is considered too long in the longitudinal direction, such tine 14 may be stiffened by a cross bridge (not shown) attaching that tine 14 to be an adjacent tine 14.

Referring to Table 1 below, a handle 10 comprising each embodiment of the present invention was compared to a control handle, made according to commonly assigned U.S. D579,615 and marketed as a Swiffer Duster® handle. For each sample, 30 commercially available Swiffer Duster® cleaning articles were inserted and removed from that handle 10. The average insertion and removal forces are shown in Table 1.

TABLE 1

| Handle (n = 30) | Average Insertion Force (N) | Average Removal Force (N) | Ratio |
|---|---|---|---|
| A Control | 20.2 BC | 6.6 | 3.4 |
| B FIGS. 1-2 | 9.2 | 3.0 AC | 3.1 |
| C FIGS. 3-4 | 11.8 | 6.4 | 1.8 |

Table 1 shows that, unexpectedly, the embodiment of FIGS. 3-4 provides the closest measurements between insertion and removal force. Thus, with lower insertion force is being required for a particular removal force less tearing of the cleaning article is likely to occur in use. Without being bound by theory, it is believed that the advantageous results shown for the embodiment of FIGS. 3-4 may be due to the absence of protrusions 30. The designations of BC and AC indicate a statistically significant difference between the other samples at the 95% confidence level.

The problem of reduced tearing of the cleaning article is significant. Upon tearing, the user considers the article to be of lesser quality. Furthermore, the cleaning article may even be unusable. The consumer would likely consider such article to be of low value. The situation is exacerbated by tolerances which occurred during manufacturing. A cleaning article which fits properly in theory may not fit well when the sleeves become tighter or looser. If the sleeves are too tight tearing may occur. If the sleeves are too loose, the article may become disengaged from the handle 10 during use. Neither situation is desirable. However, Table 1 above shows a ratio of insertion force to removal force of less than 2 and even less than 1.9, with a removal force of greater than 6 N is achievable.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. An elongate handle for removably receiving a cleaning implement, said handle having a longitudinal axis and comprising:

a grip;

at least a pair of tines attached at respective proximal ends to said grip, each said tine extending from said respective proximal end to a respective distal end, said tines defining a flat reference plane and a thickness perpendicular thereto and having a width greater than said thickness, said flat reference plane being parallel to said longitudinal axis, at least a portion of each said tine being coplanar with said reference plane for a longitudinal finite distance greater than the thickness of said tine and a portion of each said tine being non-coplanar with respect to said reference plane by an amount greater than said thickness of said tine, neither said tine being helical in the longitudinal direction.

2. A handle according to claim 1 wherein said reference plane defines two opposed surfaces, and said portions of said tines disposed non-coplanar with said reference plane are disposed outboard of both said surfaces of said reference plane.

3. A handle according to claim 2 wherein said tines are mutually co-planar along said longitudinal axis.

4. A handle according to claim 1 wherein each said tine has a length between said proximal end and said distal end, and further a portion of said tine is non-coplanar with said reference plane substantially throughout said length.

5. A handle according to claim 1 wherein said tines are not mirror images of one another.

6. A handle for removably receiving a cleaning implement, said handle having a longitudinal axis and comprising:

a grip;

a pair of tines attached at respective proximal ends to said grip, each said tine extending from a said respective proximal end to a respective distal end, said tines defining a flat reference plane and a thickness perpendicular thereto and having a width greater than said thickness, said flat reference plane being parallel to said longitudinal axis, at least a portion of each said tine being coplanar with said reference plane for a longitudinal finite distance at least equal to the thickness of said tine and a portion of each said tine being non-coplanar with respect to said reference plane by an amount greater than said thickness of said tine, said thickness of said tine being perpendicular to said reference plane in said portion of said tine coplanar therewith, wherein each said tine has an inboard edge disposed proximate to the longitudinal axis and a respective outboard edge transversely spaced therefrom, at least a portion of each said outboard edge being further from said reference plane than said respective inboard edge, neither said tine being helical in the longitudinal direction.

7. An elongate handle for removable attachment to a cleaning implement, said handle comprising:

a grip;

at least two tines attached endwise to said grip, each said tine being elongate, and further having a respective longitudinal axis, a first portion of each said tine being generally oriented concave toward a respective mirror image of said other tine and a second portion of each said tine lying in a common flat reference plane, said two portions of each said tine being non-coplanar throughout said first portion and coplanar with said reference plane throughout said second portion, neither said tine being helical in the longitudinal direction.

8. A handle according to claim 7 comprising two tines spaced apart about said longitudinal axis, each said tine comprising a generally flat blade.

9. A handle according to claim 8 wherein said tines extend from a proximal end at a common point to respective spaced apart distal ends and defining a length therebetween, said length of said tines being equal.

10. A handle according to claim 8 wherein each said tine has a width and said width of a said tine increases from a proximal end to a point intermediate said proximal end and a distal end, and decreases from said intermediate point to said distal end.

11. A handle according to claim 7 wherein each said tine has a width and at least one of said tines is hollow, defining a slot through said tine and lying within the width of said tine.

12. A handle according to claim 7 wherein said tines define respective concave faces and respective convex faces, said concave faces being generally non-flat.

13. A handle according to claim 12 wherein said concave faces of said tines define an included angle therebetween of 90 to 140 degrees.

14. A handle according to claim 13 wherein said concave faces of said tines define an included angle therebetween of 110 to 130 degrees.

* * * * *